US010991300B2

(12) United States Patent
Kim et al.

(10) Patent No.: US 10,991,300 B2
(45) Date of Patent: Apr. 27, 2021

(54) PIXEL AND ORGANIC LIGHT-EMITTING DISPLAY DEVICE INCLUDING THE SAME

(71) Applicant: Samsung Display Co., Ltd., Yongin-si (KR)

(72) Inventors: Jong Hee Kim, Yongin-si (KR); Ji Hye Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/134,923

(22) Filed: Sep. 18, 2018

(65) Prior Publication Data

US 2019/0189053 A1 Jun. 20, 2019

(30) Foreign Application Priority Data

Dec. 20, 2017 (KR) ..... 10-2017-0176357

(51) Int. Cl.
*G09G 3/3208* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01);
(Continued)

(58) Field of Classification Search
CPC ..... G09G 3/3266; G09G 3/3275
See application file for complete search history.

(56) References Cited

U.S. PATENT DOCUMENTS 7,180,486 B2 2/2007 Jeong
8,547,372 B2 10/2013 Chung et al.
8,686,926 B2 4/2014 Han et al.
(Continued)

FOREIGN PATENT DOCUMENTS

EP 3109853 12/2016
KR 10-0570995 4/2006
(Continued)

OTHER PUBLICATIONS

Extended European Search Report dated Apr. 17, 2019, in European Patent Application No. 18214632.4.

*Primary Examiner* — Roy P Rabindranath
(74) *Attorney, Agent, or Firm* — H.C. Park & Associates, PLC

(57) ABSTRACT

A pixel includes an organic light-emitting diode (OLED), a storage capacitor, and first to fourth transistors. The first transistor includes a gate electrode (GE), a first electrode (FE), and a second electrode (SE), and is configured to control, in response to a voltage of a first node (FN) coupled to the GE, current supplied from a first power source (PS) coupled to the FE to a second PS via the OLED. The storage capacitor is coupled between the FN and the first PS. The second transistor is coupled between a data line and the first transistor. The third transistor includes a FE coupled to the FN and a SE coupled to the SE of the first transistor. The fourth transistor includes a FE coupled to the FN and a SE coupled to the SE of the first transistor, and is configured to transmit an initialization voltage to the FN.

7 Claims, 10 Drawing Sheets

(52) U.S. Cl.
CPC ..... *G09G 2320/0214* (2013.01); *G09G 2320/0238* (2013.01); *G09G 2320/0247* (2013.01)

(56) References Cited

U.S. PATENT DOCUMENTS

| | | | | |
|---|---|---|---|---|
| 8,797,314 | B2 | 8/2014 | Chung et al. | |
| 9,208,727 | B2 | 12/2015 | Lee et al. | |
| 2012/0001896 | A1* | 1/2012 | Han | G09G 3/3233 345/214 |
| 2016/0275869 | A1 | 9/2016 | Hwang et al. | |
| 2016/0335950 | A1* | 11/2016 | Kang | G09G 3/2085 |
| 2017/0098413 | A1* | 4/2017 | Lee | G11C 19/28 |

FOREIGN PATENT DOCUMENTS

| | | |
|---|---|---|
| KR | 10-0604059 | 7/2006 |
| KR | 10-0673759 | 1/2007 |
| KR | 10-1058116 | 8/2011 |
| KR | 10-1097325 | 12/2011 |
| KR | 10-1578865 | 12/2015 |

* cited by examiner

PIXEL AND ORGANIC LIGHT-EMITTING DISPLAY DEVICE INCLUDING THE SAME

CROSS-REFERENCE TO RELATED APPLICATION

This application claims priority from and the benefit of Korean Patent Application No. 10-2017-0176357, filed Dec. 20, 2017, which is hereby incorporated by reference for all purposes as if fully set forth herein.

BACKGROUND

Field

Various exemplary embodiments of the present disclosure generally relate to a pixel and an organic light-emitting display device including the pixel.

Discussion

An organic light-emitting display device displays an image using organic light-emitting diodes that generate light by recombination of electrons and holes. The organic light-emitting display device is advantageous in that it has a relatively high (or quick) response speed and is able to display a clear image. Generally, an organic light-emitting display device includes a plurality of pixels, each of which includes a driving transistor and an organic light-emitting diode. Each pixel may control current to be supplied to the organic light-emitting diode using the driving transistor, thus, controlling an expression of a corresponding gradation.

The above information disclosed in this section is only for understanding the background of the inventive concepts, and, therefore, may contain information that does not form prior art.

SUMMARY

Some exemplary embodiments are directed to a display device configured to minimize leakage current in a pixel, thereby displaying a desired image without a flicker phenomenon.

Additional aspects will be set forth in the detailed description which follows, and, in part, will be apparent from the disclosure, or may be learned by practice of the inventive concepts.

According to some exemplary embodiments, a pixel includes an organic light-emitting diode, a first transistor, a storage capacitor, a second transistor, a third transistor, and a fourth transistor. The first transistor includes a gate electrode, a first electrode, and a second electrode. The first transistor is configured to control, in response to a voltage of a first node coupled to the gate electrode, current supplied from a first power source coupled to the first electrode to a second power source via the organic light-emitting diode. The storage capacitor is coupled between the first node and the first power source. The second transistor is coupled between a data line and the first transistor. The third transistor includes a first electrode coupled to the first node and a second electrode coupled to the second electrode of the first transistor. The fourth transistor includes a first electrode coupled to the first node and a second electrode coupled to the second electrode of the first transistor. The fourth transistor is configured to transmit an initialization voltage to the first node.

In some exemplary embodiments, the pixel may include a seventh transistor. The seventh transistor may include a first electrode coupled to a first electrode of the organic light-emitting diode, and a second electrode coupled to a power source configured to supply the initialization voltage.

In some exemplary embodiments, in an operational state of the pixel, the fourth transistor and the seventh transistor may be configured to be simultaneously turned on.

In some exemplary embodiments, in the operational state of the pixel, the initialization voltage may successively pass through the seventh transistor and the fourth transistor and then pass to the first node.

In some exemplary embodiments, the pixel may further include a fifth transistor coupled between the first power source and the first transistor, and a sixth transistor coupled between the second electrode of the fourth transistor and the first electrode of the seventh transistor. In an operational state of the pixel, the fifth transistor and the sixth transistor may be configured to be successively turned off.

In some exemplary embodiments, the pixel may further include a fifth transistor coupled between the first power source and the first transistor, and a sixth transistor coupled between the second electrode of the third transistor and the second electrode of the fourth transistor. In an operational state of the pixel, the fifth transistor and the sixth transistor may be configured to be simultaneously turned off.

In some exemplary embodiments, the pixel may further include a fifth transistor coupled between the first power source and the first transistor, a sixth transistor coupled between the second electrode of the first transistor and a first electrode of the organic light-emitting diode, a seventh transistor coupled between the first electrode of the organic light-emitting diode and an initialization power source configured to supply the initialization voltage, and an eighth transistor coupled between the second electrode of the first transistor and the initialization power source.

In some exemplary embodiments, in an operational state of the pixel, the fourth transistor and the eighth transistor may be configured to be simultaneously turned on.

In some exemplary embodiments, in the operational state, the initialization voltage may successively pass through the eighth transistor and the fourth transistor, and then pass to the first node.

According to some exemplary embodiments, a pixel includes an organic light-emitting diode, a first transistor, a second transistor, a third transistor, and a fourth transistor. The first transistor includes a first electrode and a second electrode. The first transistor is configured to control, in response to a voltage of a first node, current supplied from a first power source coupled to the first electrode to a second power source via the organic light-emitting diode. The second transistor is coupled between a data line and the first transistor. The third transistor includes a first electrode coupled to the first node and a second electrode coupled to the first electrode or the second electrode of the first transistor. The fourth transistor includes a first electrode coupled to the second electrode of the third transistor and a second electrode coupled to an initialization power source.

In some exemplary embodiments, the pixel may further include a fifth transistor coupled between the first power source and the first transistor, and a sixth transistor coupled between the first transistor and a first electrode of the organic light-emitting diode.

In some exemplary embodiments, in an operational state of the pixel, the fifth transistor and the sixth transistor may be configured to be simultaneously turned on.

In some exemplary embodiments, the pixel may further include a seventh transistor. The seventh transistor may include a first electrode coupled to the first electrode of the organic light-emitting diode, and a second electrode coupled to the initialization power source.

In some exemplary embodiments, a gate electrode of the fourth transistor may be coupled to a gate electrode of the seventh transistor.

In some exemplary embodiments, the second transistor may be coupled to the first electrode of the first transistor, and the third transistor may be coupled to the second electrode of the first transistor.

In some exemplary embodiments, the third transistor may be coupled to the first electrode of the first transistor, and the second transistor may be coupled to the second electrode of the first transistor.

In some exemplary embodiments, in an operational state of the pixel, the fifth transistor and the sixth transistor may be configured to be successively turned off.

In some exemplary embodiments, a turn-on period of the third transistor and a turn-on period of the fourth transistor may overlap each other.

According to some exemplary embodiments, a display device includes a first scan line, a data line, and a pixel coupled to the first scan line and the data line. The pixel includes an organic light-emitting diode, a first transistor, a storage capacitor, a second transistor, a third transistor, and a fourth transistor. The first transistor includes a gate electrode, a first electrode, and a second electrode. The first transistor is configured to control, in response to a voltage of a first node coupled to the gate electrode, current supplied from a first power source coupled to the first electrode to a second power source via the organic light-emitting diode. The storage capacitor is coupled between the first node and the first power source. The second transistor is coupled to the first scan line, the data line, and the first transistor. The third transistor includes a first electrode coupled to the first node and a second electrode coupled to the second electrode of the first transistor. The fourth transistor includes a first electrode coupled to the first node and a second electrode coupled to the second electrode of the first transistor. The fourth transistor is configured to transmit an initialization voltage to the first node.

In some exemplary embodiments, the display device may further include a second scan line coupled to the pixel. The first and second scan lines may be coupled to different scan drivers, and the third transistor may be coupled to a different one of the scan drivers than the second transistor.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
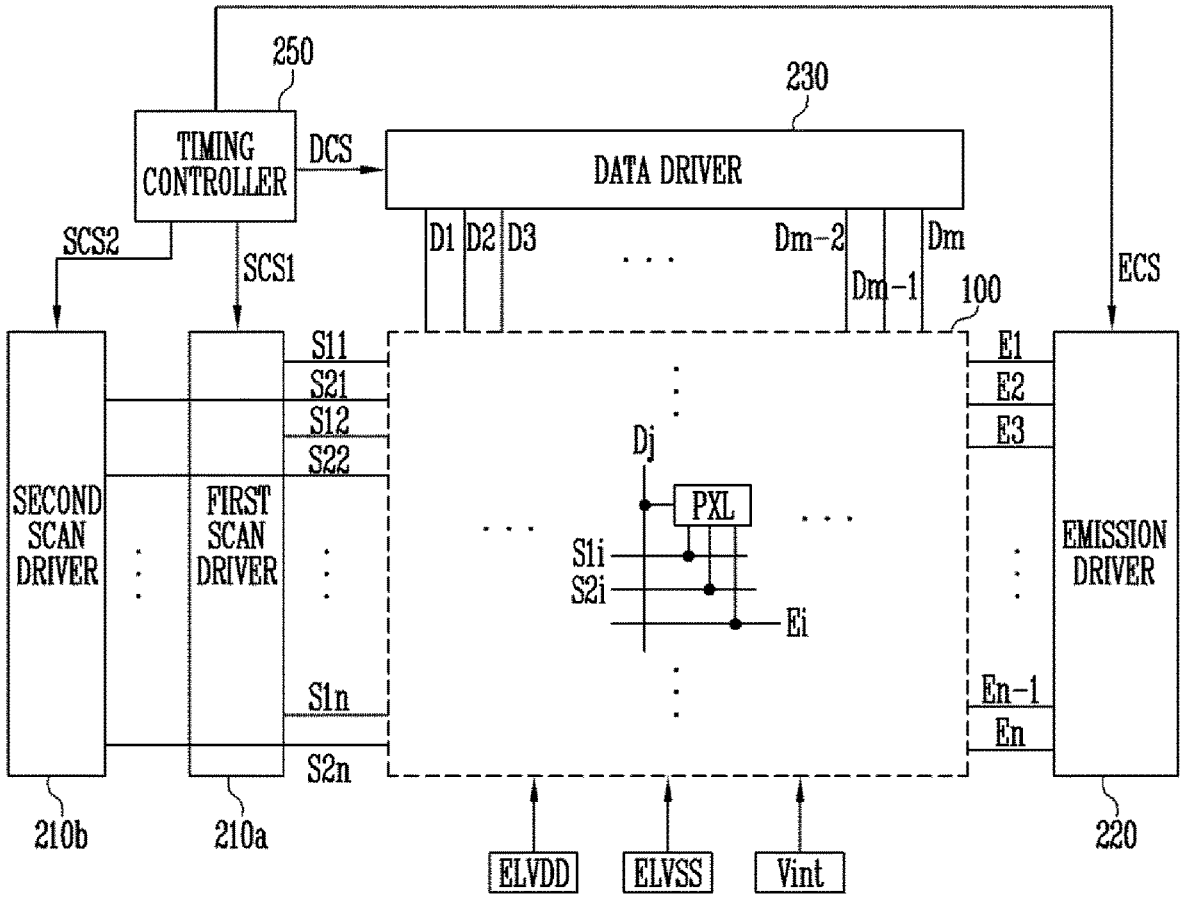
FIG. 1 is a diagram schematically illustrating the configuration of a display device according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like or similar reference numerals denote like or similar elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. To this end, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various pixels, methods of driving a pixel, and organic light-emitting display devices including at least one pixel in accordance with various exemplary embodiments will be described with reference to the accompanying drawings.

FIG. 1 is a diagram schematically illustrating the configuration of a display device according to some exemplary embodiments.

Referring to FIG. 1, the organic light-emitting display device may include a pixel unit 100, a first scan driver 210*a*, a second scan driver 210*b*, an emission driver 220, a data driver 230, and a timing controller 250.

The timing controller 250 may generate scan driving control signals SCS1 and SCS2, a data driving control signal DCS, and an emission driving control signal ECS, based on signals input from an external device. Generated from the timing controller 250, the scan driving control signals SCS1 and SCS2 may be supplied to the scan drivers 210*a* and 210*b*, the data driving control signal DCS may be supplied to the data driver 230, and the emission driving control signal ECS may be supplied to the emission driver 220.

Each of the scan driving control signals SCS1 and SCS2 and the emission driving control signal ECS may include at least one clock signal and a start pulse. The start pulse may control a timing of a first scan signal or a first emission control signal. The clock signal may be used to shift the start pulse.

The data driving control signal DCS may include a source start pulse and clock signals. The source start pulse may control a sampling start time of data, and the clock signals may be used to control a sampling operation.

The first scan driver 210*a* may supply first scan signals to first scan lines S11 to S1*n* ("n" being a natural number greater than or equal to two) in response to the first scan driving control signal SCS1. For example, the first scan driver 210*a* may successively supply the first scan signals to the first scan lines S11 to S1*n*. When the first scan signals are successively supplied to the first scan lines S11 to S1*n*, pixels PXL may be selected on a horizontal line basis. The first scan signals may be set to a gate-on voltage (e.g., a low-level voltage) so that transistors included in the pixels PXL may be turned on.

The second scan driver 210*b* may supply second scan signals to second scan lines S21 to S2*n* in response to the second scan driving control signal SCS2. For example, the second scan driver 210*b* may successively supply the second scan signals to the second scan lines S21 to S2*n*. The second scan signals may be set to a gate-on voltage (e.g., a low-level voltage) so that transistors included in the pixels PXL can be turned on.

The data driver 230 may supply data signals to data lines D1 to Dm ("m" being a natural number greater than or equal to two) in response to the data driving control signal DCS. The data signals supplied to the data lines D1 to Dm may be supplied to pixels PXL selected by the first scan signals. For this operation, the data driver 230 may supply the data signals to the data lines D1 to Dm in synchronization with the first scan signals.

The emission driver 220 may supply emission control signals to emission control lines E1 to En in response to the emission driving control signal ECS. For example, the emission driver 220 may successively supply the emission control signals to the emission control lines E1 to En. If the emission control signals are successively supplied to the emission control lines E1 to En, the pixels PXL may enter a non-emission state on a horizontal line basis. To this end, the emission control signals may be set to a gate-off voltage (e.g., a high-level voltage) so that the transistors included in the pixels PXL can be turned off.

Although the scan drivers 210*a* and 210*b* and the emission driver 220 have been illustrated in FIG. 1 as being separate components, the present disclosure is not limited thereto. For instance, the scan drivers 210*a* and 210*b* and the emission driver 220 may be formed into a single driver.

The scan drivers 210*a* and 210*b* and/or the emission driver 220 may be mounted on a substrate through a thin film process. Furthermore, the scan drivers 210*a* and 210*b* and/or the emission driver 220 may be disposed on each of opposing sides of the pixel unit 100, e.g., right and left sides of the pixel unit 100.

The pixel unit 100 may include a plurality of pixels PXL that are coupled with the data lines D1 to Dm, the scan lines S11 to S1*n* and S21 to S2*n*, and the emission control lines E1 to En. The pixels PXL may be supplied with an initialization power source Vint, a first power source ELVDD, and a second power source ELVSS from the external device. Each of the pixels PXL may be selected when a scan signal is supplied to a corresponding one of the first scan lines S11 to S1*n* that is coupled with the pixel PXL, and then be supplied with a data signal from a corresponding one of the data lines D1 to Dm. The pixel PXL supplied with the data signal may control, in response to the data signal, current flowing from the first power source ELVDD to the second power source ELVSS via an organic light-emitting diode (not shown).

The organic light-emitting diode may generate light having a predetermined luminance in response to the current. In addition, the voltage of the first power source ELVDD may be set to a value higher than that of the second power source ELVSS.

Although FIG. 1 illustrates an example in which each pixel PXL is coupled to a single first scan line S1*i* ("i" being a natural number greater than zero), a single second scan line S2*i*, a single data line Dj ("j" being a natural number greater than zero), and a single emission control line Ei, the present disclosure is not limited thereto. For example, depending on a circuit structure of each pixel PXL, a plurality of scan lines S11 to S1*n* and S21 to S2*n* may be coupled to the pixel PXL, and a plurality of emission control lines E1 to En may be coupled to the pixel PXL. In some cases, the pixels PXL may be coupled to only the first scan lines S11 to S1*n* and the data lines D1 to Dm. In these cases, the second scan lines S21 to S2*n*, the second scan driver 210*b* provided to drive the second scan lines S21 to S2*n*, the emission control line E1 to En, and the emission driver 220 provided to drive the emission control lines E1 to En may be omitted.

Figure 2:
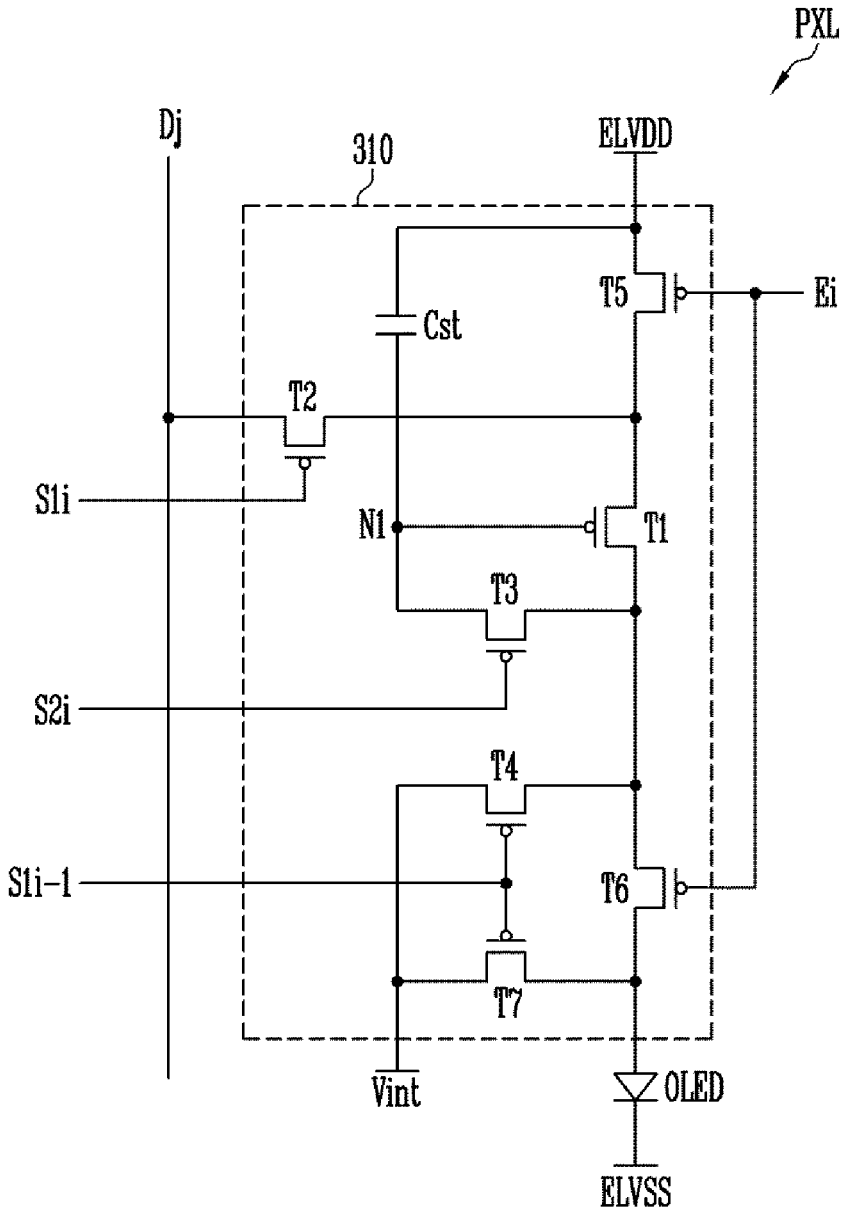
FIG. 2 is a diagram illustrating an example of a pixel shown in FIG. 1 according to some exemplary embodiments.

FIG. 2 is a diagram illustrating an example of a pixel shown in FIG. 1 according to some exemplary embodiments. In FIG. 2, for the sake of description, there is illustrated a pixel PXL that is disposed on an i-th horizontal line and coupled with an j-th data line Dj. The pixel PXL may be representative of the pixels PXL of the organic light-emitting display device of FIG. 1.

Referring to FIG. 2, the pixel PXL may include an organic light-emitting diode OLED, and a pixel circuit 310 configured to control current to be supplied to the organic light-emitting diode OLED.

An anode electrode of the organic light-emitting diode OLED may be coupled to the pixel circuit 310, and a cathode electrode thereof may be coupled to the second power source ELVSS. The organic light-emitting diode OLED may emit light having a predetermined luminance corresponding to current supplied from the pixel circuit 310. The pixel circuit 310 may control, in response to the data signal, current flowing from the first power source ELVDD to the second power source ELVSS via the organic light-emitting diode OLED.

The pixel circuit 310 may include first to seventh transistors T1 to T7, and a storage capacitor Cst.

The seventh transistor T7 may be coupled between the initialization power source Vint and the anode of the organic light-emitting diode OLED. For example, a first electrode of the seventh transistor T7 may be coupled to the anode electrode of the organic light-emitting diode OLED. A second electrode of the seventh transistor T7 may be coupled to a supply line of the initialization power source Vint. A gate electrode of the seventh transistor T7 may be coupled to an i−1-th first-scan line S1*i*−1. When a first scan signal is supplied to the i−1-th first-scan line S1*i*−1, the seventh transistor T7 may be turned on so that a voltage of the initialization power source Vint may be supplied to the anode of the organic light-emitting diode OLED. The initialization power source Vint may be set to a voltage lower than that of the data signal.

The sixth transistor T6 may be coupled between the first transistor T1 and the organic light-emitting diode OLED. For example, a second electrode of the sixth transistor T6 may be coupled to a second electrode of the first transistor T1. A first electrode of the sixth transistor T6 may be coupled to a common node between the anode electrode of the organic light-emitting diode OLED and the first electrode of the seventh transistor T7. A gate electrode of the sixth transistor T6 may be coupled to an i-th emission control line Ei. The sixth transistor T6 may be turned off when an emission control signal is supplied to the i-th emission control line Ei, and may be turned on in the other cases.

The fifth transistor T5 may be coupled between the first power source ELVDD and the first transistor T1. For example, a first electrode of the fifth transistor T5 may be coupled to a first electrode of the first transistor T1. A second electrode of the fifth transistor T5 may be coupled to a supply line of the first power source ELVDD. A gate electrode of the fifth transistor T5 may be coupled to the i-th emission control line Ei. The fifth transistor T5 may be turned off when an emission control signal is supplied to the i-th emission control line Ei, and may be turned on in the other cases.

The first electrode of the first transistor T1 (e.g., a driving transistor) may be coupled to the first power source ELVDD via the fifth transistor T5, and the second electrode thereof may be coupled to the anode of the organic light-emitting diode OLED via the sixth transistor T6. A gate electrode of the first transistor T1 may be coupled to a first node N1. The first transistor T1 may control, in response to the voltage of the first node N1, current flowing from the first power source ELVDD to the second power source ELVSS via the organic light-emitting diode OLED.

The third transistor T3 may be coupled between the second electrode of the first transistor T1 and the first node N1. A gate electrode of the third transistor T3 may be coupled to an i-th second-scan line S2*i*. When a scan signal is supplied to the i-th second-scan line S2*i*, the third transistor T3 is turned on so that the second electrode of the first transistor T1 may be electrically coupled with the first node N1. Therefore, when the third transistor T3 is turned on, the first transistor T1 may be connected in the form of a diode.

The fourth transistor T4 may be coupled between the second electrode of the first transistor T1 and the initialization power source Vint. For example, a first electrode of the fourth transistor T4 may be coupled to the supply line of the initialization power source Vint. A second electrode of the fourth transistor T4 may be coupled to the second electrode of the first transistor T1. A gate electrode of the fourth transistor T4 may be coupled to an i−1-th first-scan line S1*i*−1. When a scan signal is supplied to the i−1-th first-scan line S1*i*−1, the fourth transistor T4 is turned on so that the voltage of the initialization power source Vint can be supplied to the first node N1.

The second transistor T2 may be coupled between the j-th data line Dj and the first electrode of the first transistor T1. A gate electrode of the second transistor T2 may be coupled to the i-th first-scan line S1*i*. When a scan signal is supplied to the i-th first-scan line S1*i*, the second transistor T2 may be turned on so that the first electrode of the first transistor T1 can be electrically coupled with the j-th data line Dj.

The storage capacitor Cst may be coupled between the first power source ELVDD and the first node N1. The storage capacitor Cst may store a voltage corresponding both to a data signal and a threshold voltage of the first transistor T1.

Figure 3:
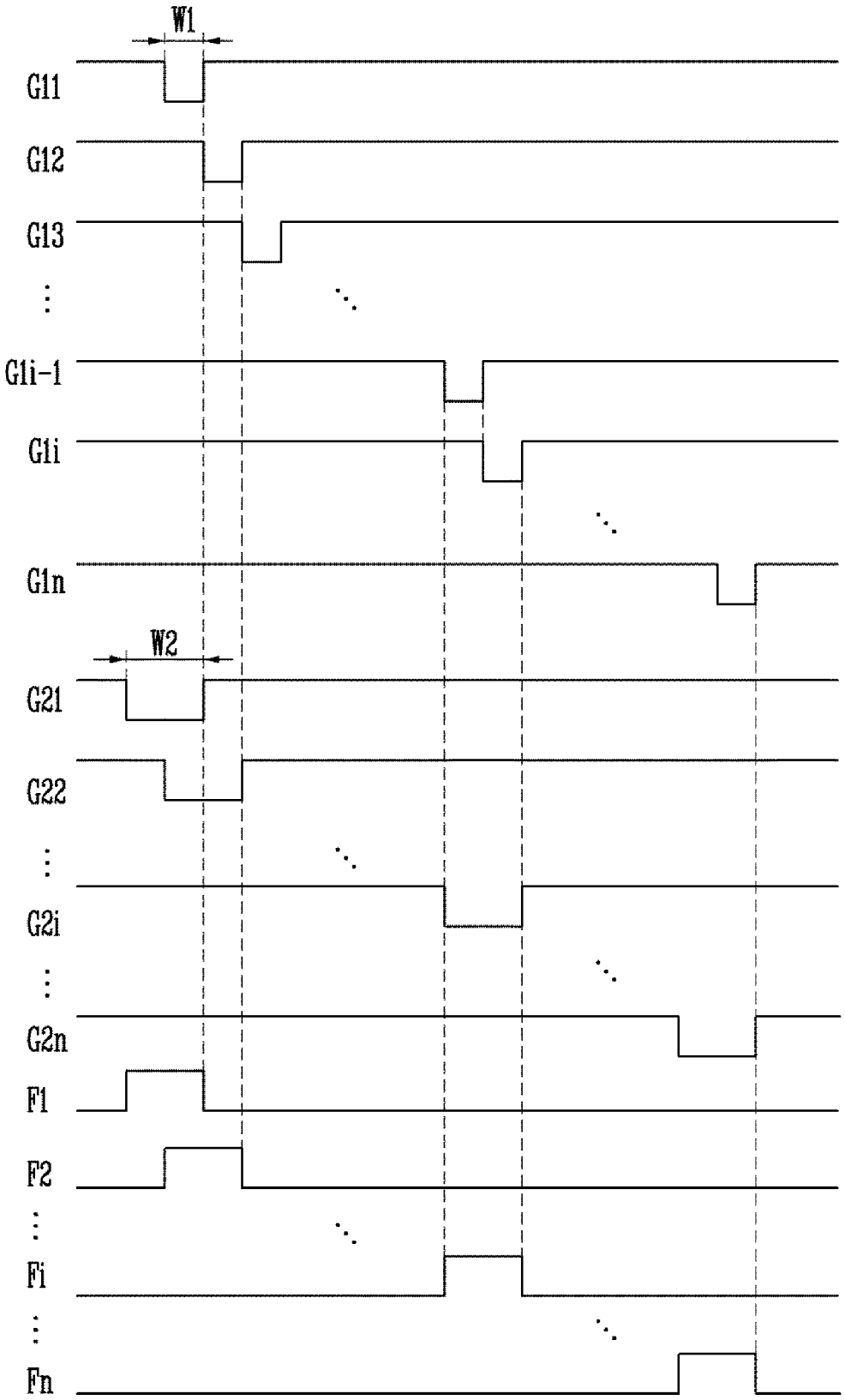
FIG. 3 is a waveform diagram illustrating signals output from one or more drivers of the display device shown in FIG. 1 according to some exemplary embodiments.

FIG. 3 is a waveform diagram illustrating signals output from one or more drivers of the display device shown in FIG. 1 according to some exemplary embodiments.

Referring to FIG. 3, the first scan signals G11 to G1*n* may be successively output. The first scan signals G11 to G1*n* may have the same width W1. Here, the term "width of a scan signal" may mean time, for which a low-level signal is supplied, in a waveform shown in the drawing.

Furthermore, the second scan signals G21 to G2*n* may be successively output. The second scan signals G21 to G2*n* may have the same width W2. The width W2 of the second scan signals G21 to G2*n* may be greater than the width W1 of the first scan signals G11 to G1*n*. For example, each second scan signal G2*i* may overlap two successive first scan signals G1*i*−1 and G1*i*.

In addition, the emission control signals F1 to Fn may be successively output. The emission control signals F1 to Fn may have the same width. Here, the width of the emission control signals F1 to Fn may be greater than the width of the first scan signals G11 to G1*n*. Any one emission control signal Fi may be supplied, overlapping any one first scan signal G1*i*. Here, the term "width of an emission control signal" may mean time, for which a high-level signal is supplied, in a waveform shown in the drawing.

Hereinafter, a method of driving the pixel PXL shown in FIG. 2 will be described with reference to FIGS. 2 and 3.

First, an emission control signal Fi is supplied to the i-th emission control line Ei. When the emission control signal Fi is supplied to the i-th emission control line Ei, the fifth transistor T5 and the sixth transistor T6 are turned off. Here, the pixel PXL may be set to a non-emission state.

Thereafter, a first scan signal G1*i*−1 is supplied to the i−1-th first-scan line S1*i*−1 and, simultaneously, a second scan signal G2*i* is supplied to the i-th second scan line S2*i*. Thereby, the third transistor T3, the fourth transistor T4, and the seventh transistor T7 are turned on. When the seventh transistor T7 is turned on, the voltage of the initialization power source Vint is supplied to the anode electrode of the organic light-emitting diode OLED. Hence, a parasitic capacitor, which is parasitically formed in the organic light-emitting diode OLED, is discharged, whereby the black expression performance may be enhanced.

If the third transistor T3 and the fourth transistor T4 are turned on at the same time, the voltage of the initialization power source Vint is supplied to the first node N1. Then, the first node N1 may be initialized to the voltage of the initialization power source Vint. When the first node N1 is initialized to the voltage of the initialization power source Vint, a first scan signal G1*i* is supplied to the i-th first-scan line S1*i*. When the first scan signal G1*i* is supplied to the i-th first-scan line S1*i*, the second transistor T2 is turned on.

The time for which the second scan signal G2*i* is supplied may be longer than the time for which the first scan signal G1*i* is supplied. For example, the i-th second-scan signal G2*i* may overlap the i−1 first-scan signal G1*i*−1 and the i-th first-scan signal G1*i*. Hence, while the first scan signal G1*i* is supplied to the i-th first-scan line S1*i*, the third transistor T3 may still remain turned on.

While the third transistor T3 remains turned on, the first transistor T1 is connected in the form of a diode. When the second transistor T2 remains turned on, a data signal is supplied from the j-th data line Dj to the first electrode of the first transistor T1. Here, since the first node N1 has been initialized to the voltage of the initialization power source Vint that is lower than the data signal, the first transistor T1 may be turned on. When the first transistor T1 is turned on, a voltage formed by subtracting the threshold voltage of the first transistor T1 from the data signal is applied to the first node N1.

The storage capacitor Cst stores a voltage corresponding both to the data signal applied to the first node N1 and to the threshold voltage of the first transistor T1. Subsequently, supply of the emission control signal Fi to the i-th emission control line Ei is interrupted. When the supply of the emission control signal Fi to the i-th emission control line Ei is interrupted, the fifth transistor T5 and the sixth transistor T6 are turned on. Then, a current path is formed that extends from the first power source ELVDD to the second power source ELVSS via the fifth transistor T5, the first transistor T1, the sixth transistor T6, and the organic light-emitting diode OLED.

Here, the first transistor T1 may control, in response to the voltage of the first node N1, current flowing from the first power source ELVDD to the second power source ELVSS via the organic light-emitting diode OLED. The organic light-emitting diode OLED may generate light having a predetermined luminance corresponding to the current supplied from the first transistor T1.

According to various exemplary embodiments, each of the pixels PXL may be controlled to repeatedly perform the above-mentioned process, and thus, generate light having a predetermined luminance.

The emission control signal Fi to be supplied to the i-th emission control line Ei may overlap at least the i-th first-scan signal G1*i* so that the pixel PXL is set to a non-emission state during a period for which the data signal is charged to the pixel PXL. Such a supply timing of the emission control signal Fi may be changed in various forms.

Unlike the structure of the pixel circuit 310, in a pixel circuit according to a conventional technique, a first electrode of a fourth transistor is coupled with a first electrode of a third transistor, and a second electrode of the fourth transistor is coupled to an initialization power source. In this case, a leakage current path is formed from a common node (a first node) between a gate electrode of a driving transistor and a storage capacitor to the initialization power source via the fourth transistor. Furthermore, a leakage current path is formed from the first node to the anode electrode of the organic light-emitting diode via the third transistor.

If the voltage of the first node varies due to leakage current, flicker may be visible on a screen. This issue is especially predominant when the organic light-emitting display device is driven with a low-frequency (e.g., 1 Hz) signal.

However, in the pixel circuit 310 according to various exemplary embodiments, there is no leakage current path to the initialization power source Vint via the fourth transistor T4. Consequently, the above-mentioned issue may be solved.

Figure 4:
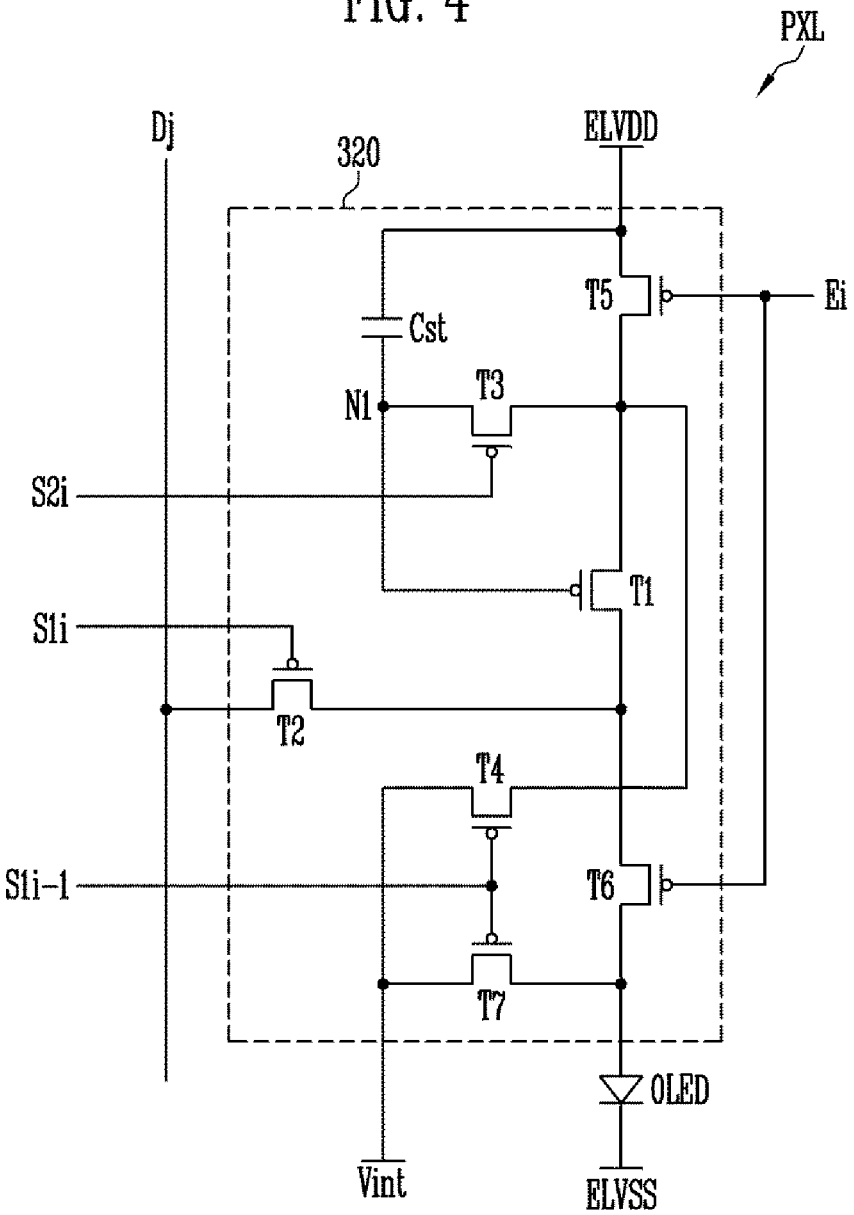
FIGS. 4 and 5 are diagrams illustrating examples of the pixel of the display device shown in FIG. 1 according to various exemplary embodiments.

FIG. 4 is a diagram illustrating an example of the pixel of the display device shown in FIG. 1 according to some exemplary embodiments. In FIG. 4, for the sake of description, there is illustrated a pixel PXL that is disposed on the i-th horizontal line and coupled with the j-th data line Dj. The description related to FIG. 4 will be focused on differences from the above-stated exemplary embodiments (e.g., the pixel circuit 310 shown in FIG. 2), and repetitive descriptions will be omitted if deemed redundant.

Referring to FIG. 4, the pixel PXL may include an organic light-emitting diode OLED, and a pixel circuit 320 configured to control current to be supplied to the organic light-emitting diode OLED. To control the current to be supplied to the organic light-emitting diode OLED, the pixel circuit 320 may include first to seventh transistors T1 to T7, and a storage capacitor Cst.

The seventh transistor T7 may be coupled between the initialization power source Vint and an anode electrode of the organic light-emitting diode OLED. A gate electrode of the seventh transistor T7 may be coupled to an i−1-th first-scan line S1*i*−1. When a first scan signal is supplied to the i−1-th first-scan line S1*i*−1, the seventh transistor T7 may be turned on so that a voltage of the initialization power supply Vint may be supplied to the anode electrode of the organic light-emitting diode OLED.

The sixth transistor T6 may be coupled between the first transistor T1 and the organic light-emitting diode OLED. A gate electrode of the sixth transistor T6 may be coupled to an i-th emission control line Ei. The sixth transistor T6 may be turned off when an emission control signal is supplied to the i-th emission control line Ei, and may be turned on in the other cases.

The fifth transistor T5 may be coupled between the first power source ELVDD and the first transistor T1. A gate electrode of the fifth transistor T5 may be coupled to the i-th emission control line Ei. The fifth transistor T5 may be turned off when an emission control signal is supplied to the i-th emission control line Ei, and may be turned on in the other cases.

A first electrode of the first transistor T1 may be coupled to the first power source ELVDD via the fifth transistor T5, and a second electrode thereof may be coupled to the anode of the organic light-emitting diode OLED via the sixth transistor T6. A gate electrode of the first transistor T1 may be coupled to a first node N1. The first transistor T1 may control, in response to the voltage of the first node N1, current flowing from the first power source ELVDD to the second power source ELVSS via the organic light-emitting diode OLED.

The third transistor T3 may be coupled between the first electrode of the first transistor T1 and the first node N1. For example, a first electrode of the third transistor T3 may be coupled to the first node N1. A second electrode of the third transistor T3 may be coupled to the first electrode of the first transistor T1. When the second transistor T2 and the third transistor T3 are turned on at the same time, a data signal is supplied from the m-th data line Dm to the second electrode of the first transistor T1.

The fourth transistor T4 may be coupled between the first electrode of the first transistor T1 (or a common node between the second electrode of the third transistor T3 and the first electrode of the fifth transistor T5) and the initialization power source Vint. For example, a first electrode of the fourth transistor T4 may be coupled to a supply line of the initialization power source Vint. A second electrode of the fourth transistor T4 may be coupled to the first electrode of the first transistor T1. A gate electrode of the fourth transistor T4 may be coupled to an i−1-th first-scan line S1*i*−1. When a first scan signal is supplied to the i−1-th first-scan line S1*i*−1, the fourth transistor T4 is turned on so that the voltage of the initialization power source Vint can be supplied to the first node N1.

The second transistor T2 may be coupled between the j-th data line Dj and the first electrode of the first transistor T1. A gate electrode of the second transistor T2 may be coupled to the i-th first-scan line S1*i*. When a first scan signal is supplied to the i-th first-scan line S1*i*, the second transistor T2 may be turned on so that the first electrode of the first transistor T1 can be electrically coupled with the j-th data line Dj.

The storage capacitor Cst may be coupled between the first power source ELVDD and the first node N1. The storage capacitor Cst may store a voltage corresponding both to a data signal and a threshold voltage of the first transistor T1.

The signals G11 to G1*n*, G21 to G2*n*, and F1 to Fn shown in FIG. 3 may be supplied to the pixel PXL (including the pixel circuit 320) shown in FIG. 4, and driven in the same sequence as that of the pixel PXL (including the pixel circuit 310) shown in FIG. 2.

Unlike the structure of the pixel circuit 320, in a pixel circuit according to a conventional technique, a first electrode of a fourth transistor is coupled with a gate electrode of a first transistor, and a second electrode of the fourth transistor is coupled to an initialization power source. In this case, a leakage current path is formed from a common node (a first node) between the gate electrode of the first transistor and a second electrode of a storage capacitor to the initialization power source via the fourth transistor. Furthermore, a leakage current path is formed from the first power source to the first node via a third transistor. If the voltage of the first node varies due to leakage current, flicker may be visible on a screen. This issue is especially predominant when the display device is driven with a low-frequency (e.g., 1 Hz) signal.

However, in the pixel circuit 320 according to various exemplary embodiments, there is no leakage current path to the initialization power source Vint via the fourth transistor T4. Consequently, the above-mentioned issue may be solved.

Figure 5:
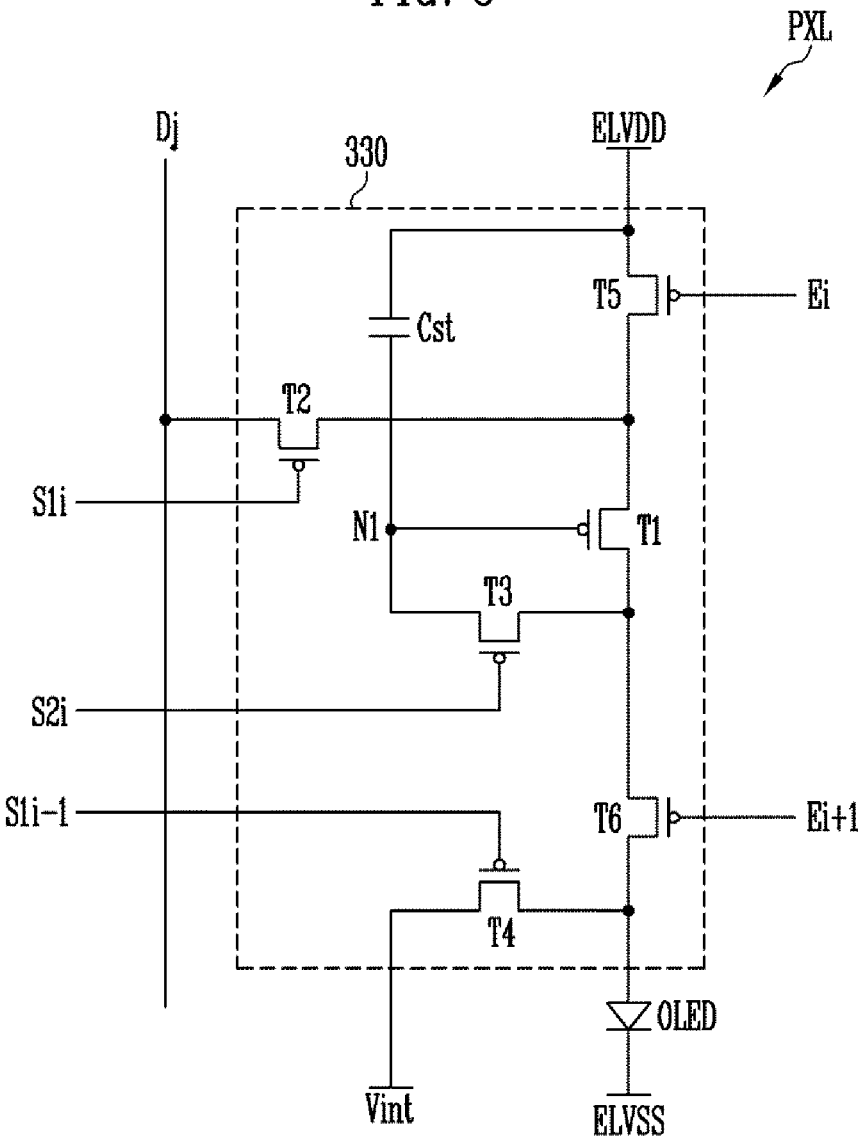

FIG. 5 is a diagram illustrating an example of the pixel of the display device shown in FIG. 1 according to some exemplary embodiments. In FIG. 5, for the sake of description, there is illustrated a pixel PXL that is disposed on an i-th horizontal line and coupled with an m-th data line Dm. The description related to FIG. 5 will be focused on differences from the above-stated exemplary embodiments (e.g., the pixel circuit 310 shown in FIG. 2), and repetitive descriptions will be omitted if deemed redundant. Therefore, the following description will be focused on connection relationship between a fourth transistor T4 and other transistors.

Referring to FIG. 5, the pixel PXL may include an organic light-emitting diode OLED, and a pixel circuit 330 configured to control current to be supplied to the organic light-emitting diode OLED. To control the current to be supplied to the organic light-emitting diode OLED, the pixel circuit 330 may include first to sixth transistors T1 to T6, and a storage capacitor Cst.

The sixth transistor T6 may be coupled between the first transistor T1 and the organic light-emitting diode OLED. A gate electrode of the sixth transistor T6 may be coupled to an i+1-th emission control line Ei+1. The sixth transistor T6 may be turned off when an emission control signal is supplied to the i+1-th emission control line Ei+1, and may be turned on in the other cases.

The fifth transistor T5 may be coupled between the first power source ELVDD and the first transistor T1. A gate electrode of the fifth transistor T5 may be coupled to the i-th emission control line Ei. The fifth transistor T5 may be turned off when an emission control signal is supplied to the i-th emission control line Ei, and may be turned on in the other cases.

A first electrode of the first transistor T1 may be coupled to the first power source ELVDD via the fifth transistor T5, and a second electrode thereof may be coupled to the anode of the organic light-emitting diode OLED via the sixth transistor T6. A gate electrode of the first transistor T1 may be coupled to a first node N1. The first transistor T1 may control, in response to the voltage of the first node N1, current flowing from the first power source ELVDD to the second power source ELVSS via the organic light-emitting diode OLED.

The third transistor T3 may be coupled between the second electrode of the first transistor T1 and the first node N1. A gate electrode of the third transistor T3 may be coupled to an i-th second-scan line S2*i*. When a scan signal is supplied to the i-th second scan line S2*i*, the third transistor T3 is turned on so that the second electrode of the first transistor T1 may be electrically coupled with the first node N1. Therefore, when the third transistor T3 is turned on, the first transistor T1 may be connected in the form of a diode.

The fourth transistor T4 may be coupled between the initialization power source Vint and the anode of the organic light-emitting diode OLED. For example, a first electrode of the fourth transistor T4 may be coupled to the anode electrode of the organic light-emitting diode OLED. A second electrode of the fourth transistor T4 may be coupled to a supply line of the initialization power source Vint. A gate electrode of the fourth transistor T4 may be coupled to an i−1-th first-scan line S1*i*−1. When a first scan signal is supplied to the i−1-th first-scan line S1*i*−1, the fourth transistor T4 may be turned on so that a voltage of the initialization power supply Vint may be supplied to the anode of the organic light-emitting diode OLED and the first node N1.

A second transistor T2 may be coupled between the j-th data line Dj and the first electrode of the first transistor T1. A gate electrode of the second transistor T2 may be coupled to the i-th first-scan line S1*i*. When a first scan signal is supplied to the i-th first-scan line S1*i*, the second transistor T2 may be turned on so that the first electrode of the first transistor T1 can be electrically coupled with the j-th data line Dj.

The storage capacitor Cst may be coupled between the first power source ELVDD and the first node N1. The storage capacitor Cst may store a voltage corresponding both to a data signal and a threshold voltage of the first transistor T1.

Hereinafter, a method of driving the pixel PXL shown in FIG. 5 will be described further with reference to FIG. 3.

First, an emission control signal Fi is supplied to the i-th emission control line Ei. When the emission control signal Fi is supplied to the i-th emission control line Ei, the fifth transistor T5 is turned off, and the pixel PXL may be set to a non-emission state. Thereafter, a first scan signal G1*i*−1 is supplied to the i−1-th first-scan line S1*i*−1 and, simultaneously, a second scan signal G2*i* is supplied to the i-th second scan line S2*i*. Thereby, the third transistor T3 and the fourth transistor T4 are turned on.

When the fourth transistor T4 is turned on, the voltage of the initialization power source Vint is supplied to the anode electrode of the organic light-emitting diode OLED. If the third transistor T3 and the fourth transistor T4 are turned on at the same time, the voltage of the initialization power source Vint is supplied to the first node N1 via the sixth transistor T6. Then, the first node N1 may be initialized to the voltage of the initialization power source Vint. Hence, until the first scan signal G1*i* is supplied to the i-th first-scan line S1*i*, the third transistor T3 may remain turned on.

Subsequently, an emission control signal Fi+1 is supplied to the i+1-th emission control line Ei+1, and the first scan signal G1*i* is supplied to the i-th first-scan line S1*i*. When the emission control signal Fi+1 is supplied, the sixth transistor T6 is turned off. While the sixth transistor T6 remains turned off, the first scan signal G1*i* is supplied so that the second transistor T2 is turned on.

When the second transistor T2 is turned on, a data signal is supplied from the j-th data line Dj to the first electrode of the first transistor T1. Furthermore, as the third transistor T3 remains turned on, the first transistor T1 is connected in the form of a diode. Here, since the first node N1 has been initialized to the voltage of the initialization power source Vint that is lower than the data signal, the first transistor T1 may be turned on. When the first transistor T1 is turned on, a voltage formed by subtracting the threshold voltage of the first transistor T1 from the data signal is applied to the first node N1.

The storage capacitor Cst stores a voltage corresponding both to the data signal applied to the first node N1 and to the threshold voltage of the first transistor T1. Thereafter, the supply of the i-th emission control signal Fi and the i+1-th emission control signal Fi+1 is successively interrupted. When the supply of the i-th emission control signal Fi is interrupted, the fifth transistor T5 is turned on. When the supply of the i+1-th emission control signal Fi+1 is interrupted, the sixth transistor T6 is turned on. Then, a current path is formed that extends from the first power source ELVDD to the second power source ELVSS via the fifth transistor T5, the first transistor T1, the sixth transistor T6, and the organic light-emitting diode OLED.

Here, the first transistor T1 may control, in response to the voltage of the first node N1, current flowing from the first power source ELVDD to the second power source ELVSS via the organic light-emitting diode OLED. The organic light-emitting diode OLED may generate light having a predetermined luminance corresponding to the current supplied from the first transistor T1.

Figure 6:
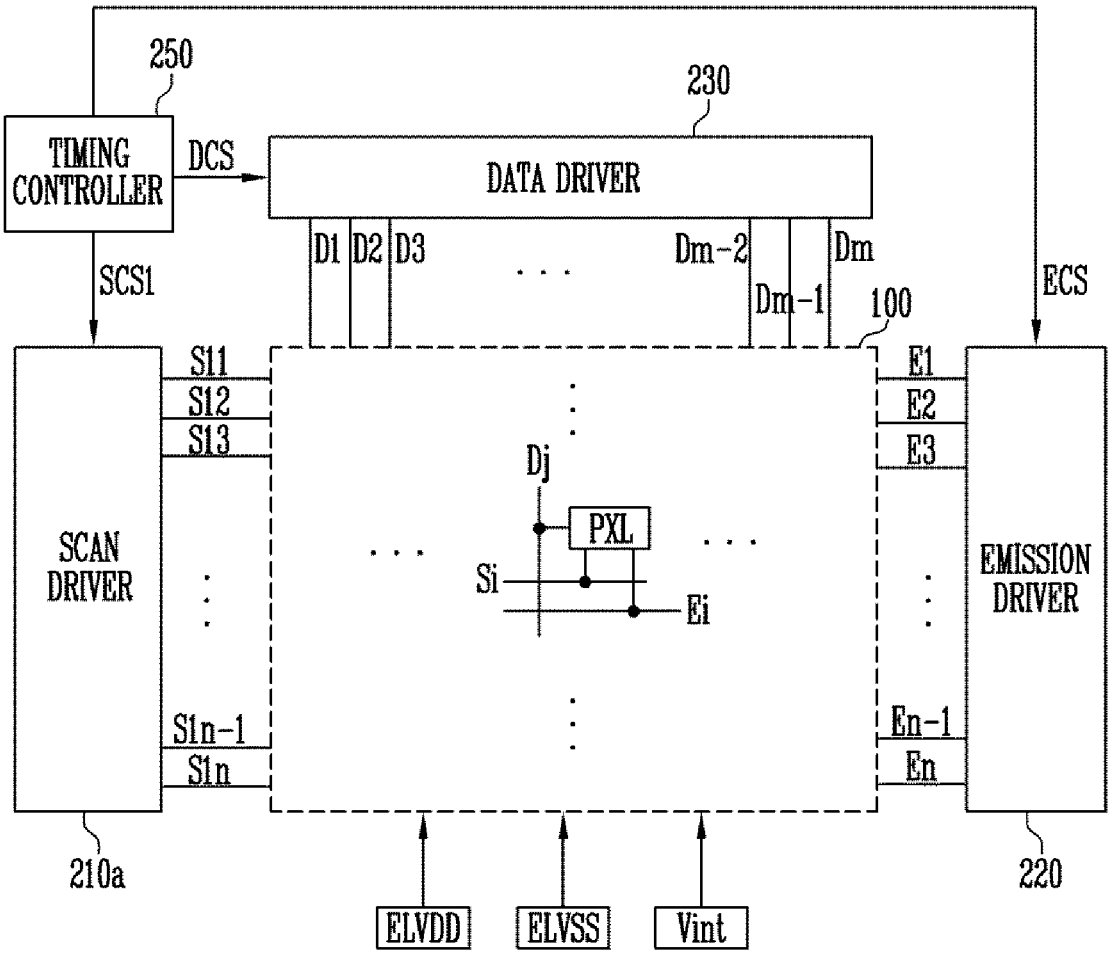
FIG. 6 is a diagram schematically illustrating the configuration of a display device according to some exemplary embodiments.

FIG. 6 is a diagram schematically illustrating the configuration of a display device according to some exemplary embodiments. The description related to FIG. 6 will be focused on differences from the above-stated exemplary embodiments (e.g., the display device shown in FIG. 1), and repetitive descriptions will be omitted if deemed redundant.

Referring to FIG. 6, the organic light-emitting display device may include a pixel unit 100, a scan driver 210*a*, an emission driver 220, a data driver 230, and a timing controller 250. Unlike the display device shown in FIG. 1, the pixel unit 100 may include a plurality of pixels PXL that are coupled with data lines D1 to Dm, scan lines S11 to S1*n*, and emission control lines E1 to En.

Although FIG. 6 illustrates an example in which each pixel PXL is coupled to a corresponding one of the first scan lines S11 to S1*n*, a corresponding one of the data lines D1 to Dm, and a corresponding one of the emission control lines E1 to En, the present disclosure is not limited thereto. In other words, depending on a circuit structure of each pixel PXL, a plurality of scan lines S11 to S1*n* may be coupled to the pixel PXL, and a plurality of emission control lines E1 to En may be coupled to the pixel PXL.

In some cases, the pixels PXL may be coupled to only the first scan lines S11 to S1*n* and the data lines D1 to Dm. In this case, the emission control lines E1 to En and the emission driver 220 for driving the emission control lines E1 to En may be omitted.

Figure 7:
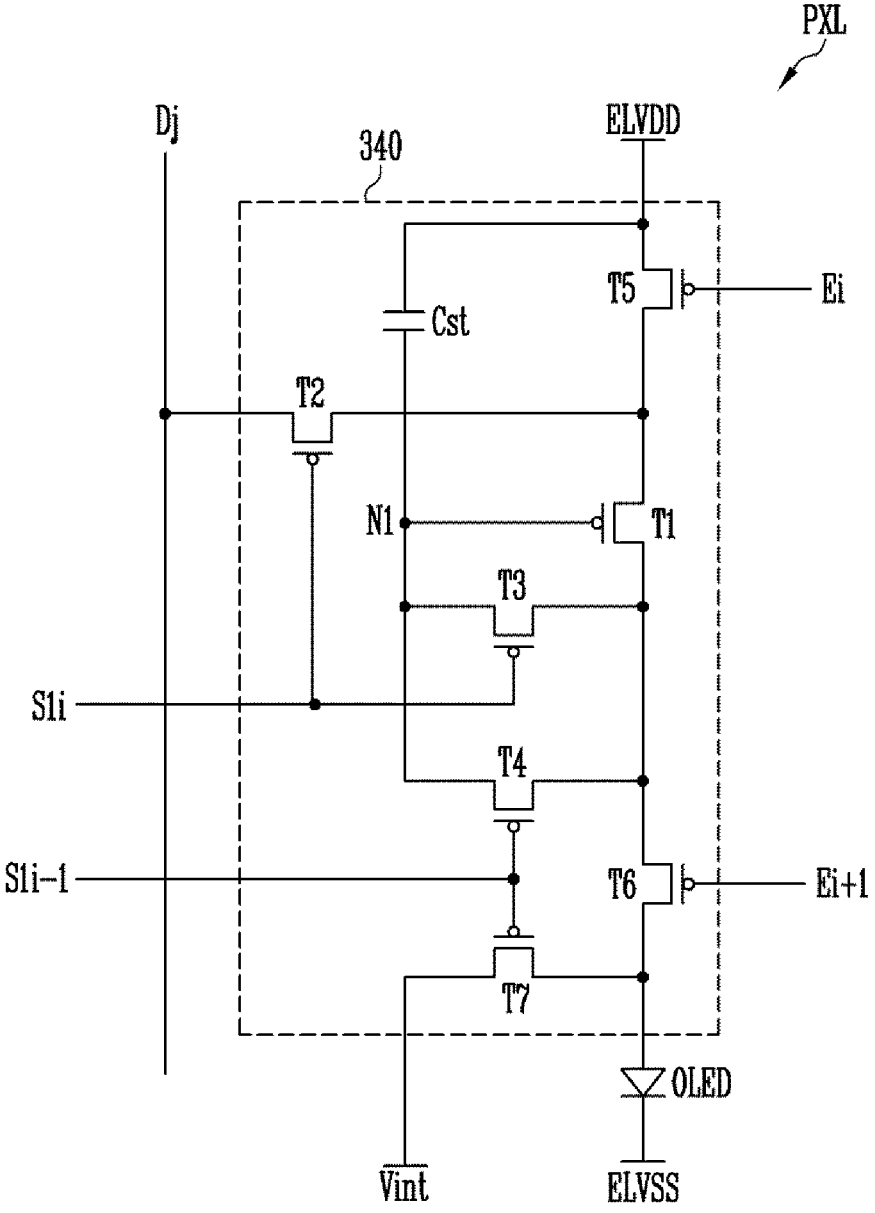
FIG. 7 is a diagram illustrating an example of a pixel of the display device shown in FIG. 6 according to some exemplary embodiments.

FIG. 7 is a diagram illustrating an example of a pixel of the display device shown in FIG. 6 according to some exemplary embodiments. In FIG. 7, for the sake of description, there is illustrated a pixel PXL that is disposed on the i-th horizontal line and coupled with the j-th data line Dj. The description related to FIG. 7 will be focused on differences from the above-stated exemplary embodiments (e.g., the pixel circuit 310 shown in FIG. 2), and repetitive descriptions will be omitted if deemed redundant.

Referring to FIG. 7, the pixel PXL may include an organic light-emitting diode OLED, and a pixel circuit 340 configured to control current to be supplied to the organic light-emitting diode OLED. To control the current to be supplied to the organic light-emitting diode OLED, the pixel circuit 340 may include first to seventh transistors T1 to T7, and a storage capacitor Cst.

The seventh transistor T7 may be coupled between the initialization power source Vint and an anode electrode of the organic light-emitting diode OLED. A gate electrode of the seventh transistor T7 may be coupled to an i−1-th first-scan line S1*i*−1. When a first scan signal is supplied to the i−1-th first-scan line S1*i*−1, the seventh transistor T7 may be turned on so that a voltage of the initialization power supply Vint may be supplied to the anode electrode of the organic light-emitting diode OLED.

The sixth transistor T6 may be coupled between the first transistor T1 and the organic light-emitting diode OLED. A gate electrode of the sixth transistor T6 may be coupled to an i+1-th emission control line Ei+1. The sixth transistor T6 may be turned off when an emission control signal is supplied to the i+1-th emission control line Ei+1, and may be turned on in the other cases.

The fifth transistor T5 may be coupled between the first power source ELVDD and the first transistor T1. A gate electrode of the fifth transistor T5 may be coupled to the i-th emission control line Ei. The fifth transistor T5 may be turned off when an emission control signal is supplied to the i-th emission control line Ei, and may be turned on in the other cases.

A first electrode of the first transistor T1 may be coupled to the first power source ELVDD via the fifth transistor T5, and a second electrode thereof may be coupled to the anode of the organic light-emitting diode OLED via the sixth transistor T6. A gate electrode of the first transistor T1 may be coupled to a first node N1. The first transistor T1 may control, in response to the voltage of the first node N1, current flowing from the first power source ELVDD to the second power source ELVSS via the organic light-emitting diode OLED.

The third transistor T3 may be coupled between the second electrode of the first transistor T1 and the first node N1. For example, a first electrode of the third transistor T3 may be coupled to the first node N1. A second electrode of the third transistor T3 may be coupled to the second electrode of the first transistor T1. When the second transistor T2 and the third transistor T3 are turned on at the same time, a data signal is supplied from the j-th data line Dj to the second electrode of the first transistor T1.

The fourth transistor T4 may be coupled between the second electrode of the first transistor T1 (or the second electrode of the third transistor T3) and the first node N1. For example, a first electrode of the fourth transistor T4 may be coupled to the first node N1. A second electrode of the fourth transistor T4 may be coupled to the second electrode of the first transistor T1. A gate electrode of the fourth transistor T4 may be coupled to an i−1-th first-scan line S1*i*−1. When a first scan signal is supplied to the i−1-th first-scan line S1*i*−1, the fourth transistor T4 is turned on. When the fourth transistor T4, the sixth transistor T6, and the seventh transistor T7 are turned on at the same time, the voltage of the initialization power source Vint may be supplied to the first node N1.

The second transistor T2 may be coupled between the j-th data line Dj and the first electrode of the first transistor T1. A gate electrode of the second transistor T2 may be coupled to the i-th first-scan line S1*i*. When a first scan signal is supplied to the i-th first-scan line S1*i*, the second transistor T2 may be turned on so that the first electrode of the first transistor T1 can be electrically coupled with the j-th data line Dj.

The storage capacitor Cst may be coupled between the first power source ELVDD and the first node N1. The storage capacitor Cst may store a voltage corresponding both to a data signal and a threshold voltage of the first transistor T1.

Figure 8:
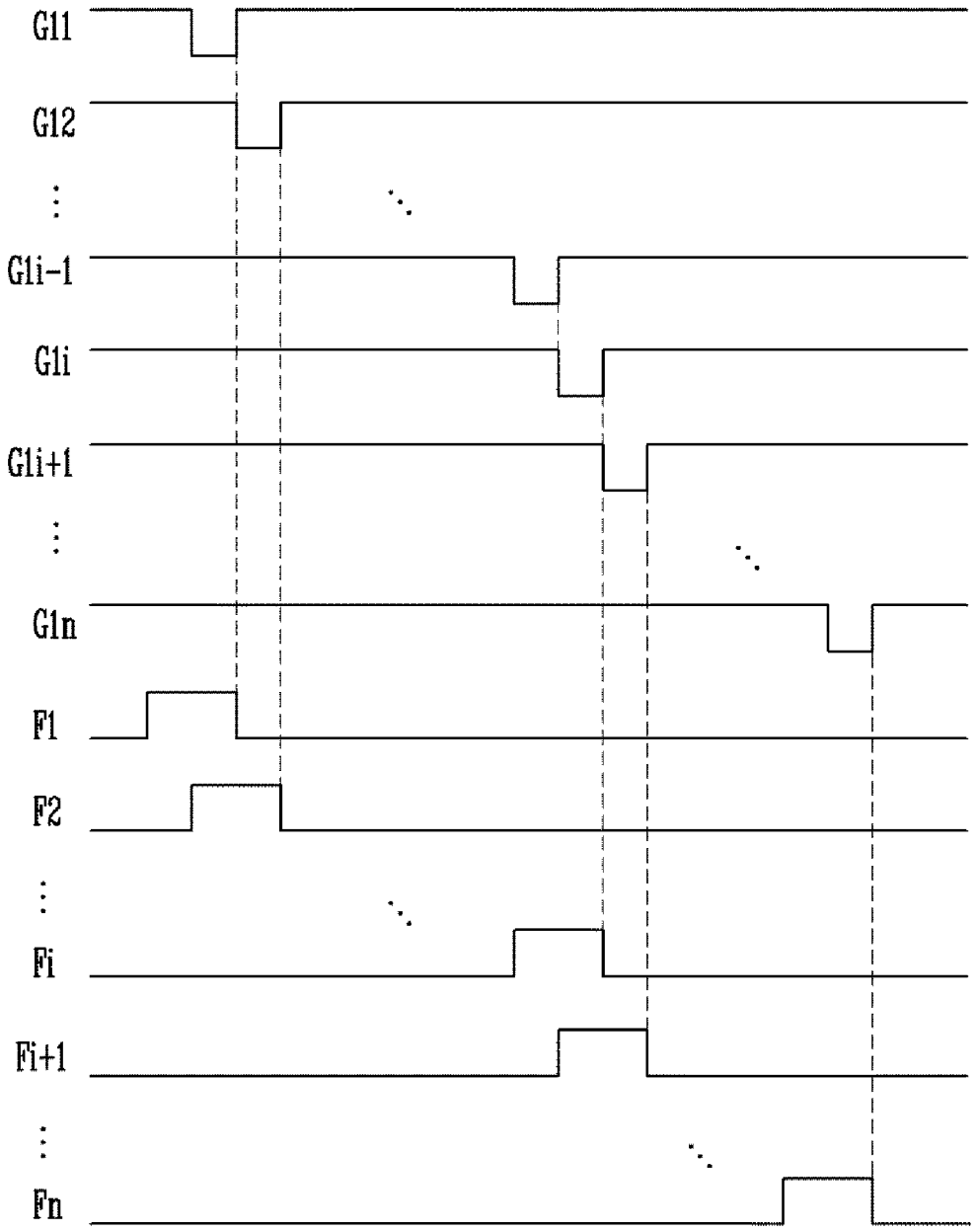
FIG. 8 is a waveform diagram illustrating signals output from drivers of the display device shown in FIG. 6 according to some exemplary embodiments.

FIG. 8 is a waveform diagram illustrating signals output from drivers of the display device shown in FIG. 6 according to some exemplary embodiments. The description related to FIG. 8 will be focused on differences from the above-stated exemplary embodiments (e.g., the waveform diagram shown in FIG. 3), and repetitive descriptions will be omitted if deemed redundant.

Referring to FIG. 8, the first scan signals G11 to G1*n* may be successively output. The first scan signals G11 to G1*n* may have the same width. In addition, the emission control signals F1 to Fn may be successively output. The emission control signals F1 to Fn may have the same width. Here, the width of the emission control signals F1 to Fn may be greater than the width of the first scan signals G11 to G1*n*. Any one emission control signal Fi may be supplied, overlapping any one first scan signal G1*i*.

Hereinafter, a method of driving the pixel PXL shown in FIG. 7 will be described with reference to FIGS. 7 and 8. The following description will be focused on differences from the above-mentioned embodiments (e.g., the method of driving the pixel PXL described with reference to FIGS. 2 and 3), and repetitive descriptions will be omitted if deemed redundant First, an emission control signal Fi is supplied to the i-th emission control line Ei. When the emission control signal Fi is supplied to the i-th emission control line Ei, the fifth transistor T5 is turned off. Here, the pixel PXL may be set to a non-emission state.

Thereafter, a first scan signal G1*i*−1 is supplied to the i−1-th first-scan line S1*i*−1. Thereby, the fourth transistor T4 and the seventh transistor T7 are turned on. Here, because it is before the emission control signal Fi+1 is supplied to the i+1-th emission control line Ei+1, the sixth transistor T6 along with the fourth transistor T4 and the seventh transistor T7 remains turned on together.

When the seventh transistor T7 is turned on, the voltage of the initialization power source Vint is supplied to the anode electrode of the organic light-emitting diode OLED. Hence, a parasitic capacitor, which is parasitically formed in the organic light-emitting diode OLED, is discharged, whereby the black expression performance may be enhanced.

When the fourth transistor T4, the sixth transistor T6, and the seventh transistor T7 are turned on at the same time, the voltage of the initialization power source Vint is supplied to the first node N1 via the fourth transistor T4, the sixth transistor T6, and the seventh transistor T7. Then, the first node N1 may be initialized to the voltage of the initialization power source Vint.

When the first node N1 is initialized to the voltage of the initialization power source Vint, a first scan signal G1*i* is supplied to the i-th first-scan line S1*i*. When the first scan signal G1*i* is supplied to the i-th first-scan line S1*i*, the second transistor T2 and the third transistor T3 are turned on.

When the third transistor T3 is turned on, the first transistor T1 is connected in the form of a diode. When the second transistor T2 is turned on, a data signal is supplied from the j-th data line Dj to the first electrode of the first transistor T1. Here, since the first node N1 has been initialized to the voltage of the initialization power source Vint that is lower than the data signal, the first transistor T1 may be turned on. When the first transistor T1 is turned on, a voltage formed by subtracting the threshold voltage of the first transistor T1 from the data signal is applied to the first node N1.

The storage capacitor Cst stores a voltage corresponding both to the data signal applied to the first node N1 and to the threshold voltage of the first transistor T1. Thereafter, the supply of the i-th emission control signal Fi and the i+1-th emission control signal Fi+1 is successively interrupted.

When the supply of the i-th emission control signal Fi is interrupted, the fifth transistor T5 is turned on. When the supply of the i+1-th emission control signal Fi+1 is interrupted, the sixth transistor T6 is turned on. Then, a current path is formed that extends from the first power source ELVDD to the second power source ELVSS via the fifth transistor T5, the first transistor T1, the sixth transistor T6, and the organic light-emitting diode OLED.

Here, the first transistor T1 may control, in response to the voltage of the first node N1, current flowing from the first power source ELVDD to the second power source ELVSS via the organic light-emitting diode OLED. The organic light-emitting diode OLED may generate light having a predetermined luminance corresponding to the current supplied from the first transistor T1.

Figure 9:
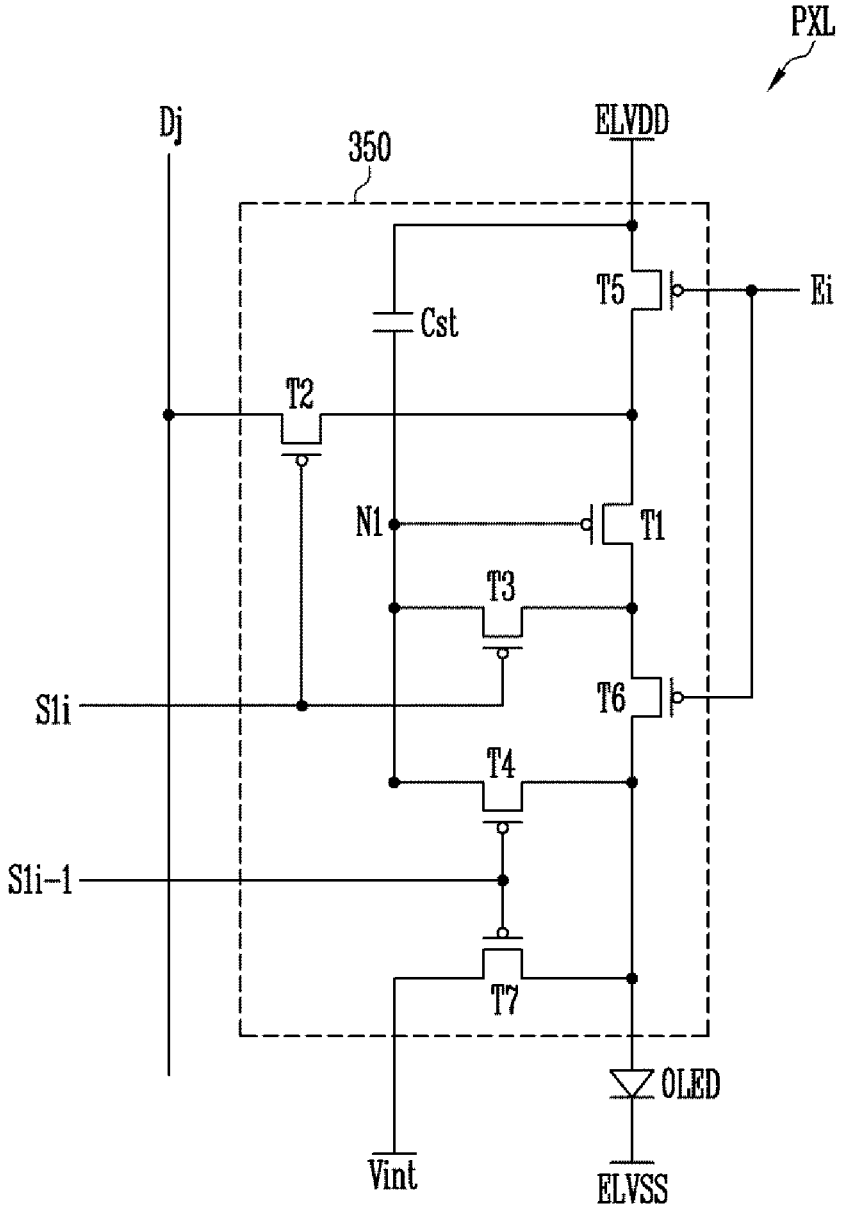
FIGS. 9 and 10 are diagrams illustrating examples of the pixel of the display device shown in FIG. 6 according to various exemplary embodiments.

FIG. 9 is a diagram illustrating an example of a pixel of the display device shown in FIG. 6 according to some exemplary embodiments. In FIG. 9, for the sake of description, there is illustrated a pixel PXL that is disposed on the i-th horizontal line and coupled with the j-th data line Dj. The description related to FIG. 9 will be focused on differences from the above-stated exemplary embodiments (e.g., the pixel circuit 340 shown in FIG. 7), and repetitive descriptions will be omitted if deemed redundant. Hence, the following description will be focused on a sixth transistor T6.

Referring to FIG. 9, the pixel PXL may include an organic light-emitting diode OLED, and a pixel circuit 350 configured to control current to be supplied to the organic light-emitting diode OLED. To control the current to be supplied to the organic light-emitting diode OLED, the pixel circuit 350 may include first to seventh transistors T1 to T7, and a storage capacitor Cst.

Particularly, the sixth transistor T6 may be coupled between the first transistor T1 and the organic light-emitting diode OLED. For example, a first electrode of the sixth transistor T6 may be coupled to a common node of an anode electrode of the organic light-emitting diode OLED, a second electrode of the fourth transistor T4, and the seventh transistor T7. A second electrode of the sixth transistor T6 may be coupled to a second electrode of the first transistor T1 (or a second electrode of the third transistor T3). A gate electrode of the sixth transistor T6 may be coupled to an i-th emission control line Ei. The sixth transistor T6 may be turned off when an emission control signal is supplied to the i-th emission control line Ei, and may be turned on in the other cases.

Hereinafter, a method of driving the pixel PXL shown in FIG. 9 will be described further with reference to FIG. 8. Particularly, the following description will be focused on differences from the above-mentioned exemplary embodiments (e.g., the method of driving the pixel shown in FIG. 7), and repetitive descriptions will be omitted if deemed redundant.

First, an emission control signal Fi is supplied to the i-th emission control line Ei. When the emission control signal Fi is supplied to the i-th emission control line Ei, the fifth transistor T5 and the sixth transistor T6 are turned off, and the pixel PXL may be set to a non-emission state.

Thereafter, a first scan signal G1*i*−1 is supplied to the i−1-th first-scan line S1*i*−1. Thereby, the fourth transistor T4 and the seventh transistor T7 are turned on. When the seventh transistor T7 is turned on, the voltage of the initialization power source Vint is supplied to the anode electrode of the organic light-emitting diode OLED. Furthermore, the voltage of the initialization power source Vint is supplied to the first node N1 via the seventh transistor T7 and the fourth transistor T4.

When the first node N1 is initialized to the voltage of the initialization power source Vint, a first scan signal G1*i* is supplied to the i-th first-scan line S1*i*. When the first scan signal G1*i* is supplied to the i-th first-scan line S1*i*, the second transistor T2 and the third transistor T3 are turned on. In other words, a voltage obtained by subtracting the threshold voltage of the first transistor T1 from the data signal is applied to the first node N1.

The storage capacitor Cst stores a voltage corresponding both to the data signal applied to the first node N1 and to the threshold voltage of the first transistor T1. Thereafter, the supply of the i-th emission control signal Fi is interrupted, so that the fifth transistor T5 and the sixth transistor T6 are turned on. Then, the organic light-emitting diode OLED may generate light having a predetermined luminance corresponding to the current supplied from the first transistor T1.

Figure 10:
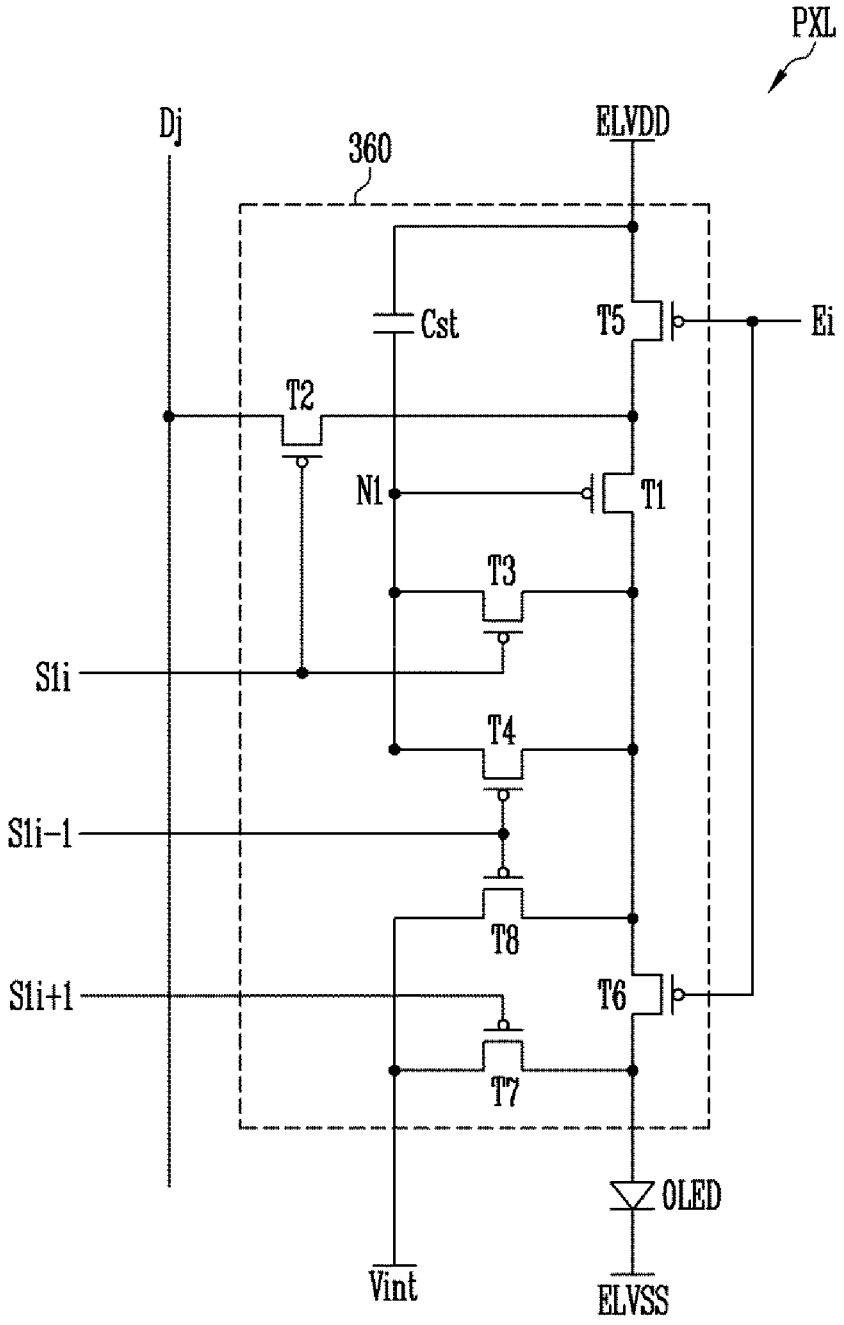

FIG. 10 is a diagram illustrating an example of a pixel of the display device shown in FIG. 6 according to some exemplary embodiments. In FIG. 10, for the sake of description, there is illustrated a pixel PXL that is disposed on the i-th horizontal line and coupled with the j-th data line Dj. The description related to FIG. 10 will be focused on differences from the above-stated exemplary embodiments (e.g., the pixel circuit 340 shown in FIG. 7), and repetitive descriptions will be omitted if deemed redundant. Hence, the following description will be focused on sixth to eighth transistors T6 to T8.

Referring to FIG. 10, the pixel PXL may include an organic light-emitting diode OLED, and a pixel circuit 360 configured to control current to be supplied to the organic light-emitting diode OLED. To control the current to be supplied to the organic light-emitting diode OLED, the pixel circuit 360 may include first to eighth transistors T1 to T8, and a storage capacitor Cst.

The eighth transistor T8 may be coupled between a second electrode of the first transistor T1 and the initialization power source Vint. For example, a first electrode of the eighth transistor T8 may be coupled to the second electrode of the first transistor T1 (or a second electrode of the third transistor T3 or a second electrode of the fourth transistor T4). A second electrode of the eighth transistor T8 may be coupled to a supply line provided to supply the initialization power source Vint. A gate electrode of the eighth transistor T8 may be coupled to an i−1-th first-scan line S1*i*−1. The eighth transistor T8 may be turned on when a first scan signal is supplied to the i−1-th first-scan line S1*i*−1, and may be turned off in the other cases.

The seventh transistor T7 may be coupled between the initialization power source Vint and the organic light-emitting diode OLED. For example, a first electrode of the seventh transistor T7 may be coupled to an anode electrode of the organic light-emitting diode OLED. A second electrode of the seventh transistor T7 may be coupled to the supply line provided to supply the initialization power source Vint. A gate electrode of the seven transistor T7 may be coupled to an i+1-th first-scan line S1*i*+1. The seventh transistor T7 may be turned on when a first scan signal is supplied to the i+1-th first-scan line S1*i*−1, and may be turned off in the other cases.

The sixth transistor T6 may be coupled between the first transistor T1 and the organic light-emitting diode OLED. For example, a first electrode of the sixth transistor T6 may be coupled to the anode electrode of the organic light-emitting diode OLED. A second electrode of the sixth transistor T6 may be coupled to the second electrode of the first transistor T1 (or a common node of the second electrode of the third transistor T3, the second electrode of the fourth transistor T4, and the eighth transistor T8). A gate electrode of the sixth transistor T6 may be coupled to an i-th emission control line Ei. The sixth transistor T6 may be turned off when an emission control signal is supplied to the i-th emission control line Ei, and may be turned on in the other cases.

Hereinafter, a method of driving the pixel PXL shown in FIG. 10 will be described further with reference to FIG. 8. Particularly, the following description will be focused on differences from the above-mentioned exemplary embodiments (e.g., the method of driving the pixel shown in FIG. 7), and repetitive descriptions will be omitted if deemed redundant.

First, an emission control signal Fi is supplied to the i-th emission control line Ei. When the emission control signal Fi is supplied to the i-th emission control line Ei, the fifth transistor T5 and the sixth transistor T6 are turned off, and the pixel PXL may be set to a non-emission state. Thereafter, a first scan signal G1*i*−1 is supplied to the i−1-th first-scan line S1*i*−1. Thereby, the fourth transistor T4 and the eighth transistor T8 are turned on.

When the fourth transistor T4 and the eighth transistor T8 are turned on at the same time, the voltage of the initialization power source Vint is supplied to the first node N1 via the eighth transistor T8 and the fourth transistor T4.

When the first node N1 is initialized to the voltage of the initialization power source Vint, a first scan signal G1*i* is supplied to the i-th first-scan line S1*i*. When the first scan signal G1*i* is supplied to the i-th first-scan line S1*i*, the second transistor T2 and the third transistor T3 are turned on. In other words, a voltage obtained by subtracting the threshold voltage of the first transistor T1 from the data signal is applied to the first node N1.

The storage capacitor Cst stores a voltage corresponding both to the data signal applied to the first node N1 and to the threshold voltage of the first transistor T1. Subsequently, a first scan signal G1*i*+1 is supplied to the i+1-th first-scan line S1*i*+1, so that the seventh transistor T7 is turned on. When the seventh transistor T7 is turned on, the voltage of the initialization power source Vint is supplied to the anode electrode of the organic light-emitting diode OLED.

Thereafter, the supply of the i-th emission control signal Fi is interrupted, so that the fifth transistor T5 and the sixth transistor T6 are turned on. Then, the organic light-emitting diode OLED may generate light having a predetermined luminance corresponding to the current supplied from the first transistor T1.

According to various exemplary embodiments, a display device may be provided and configured to minimize leakage current in a pixel, thereby displaying a desired image without (or with less of) a flicker phenomenon.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A pixel comprising:

an organic light-emitting diode;

a first transistor comprising a gate electrode, a first electrode, and a second electrode, the first transistor being configured to control, in response to a voltage of a first node coupled to the gate electrode, current supplied from a first power source coupled to the first electrode to a second power source via the organic light-emitting diode;

a storage capacitor coupled between the first node and the first power source;

a second transistor coupled between a data line and the first transistor;

a third transistor comprising a first electrode coupled to the first node and a second electrode coupled to the second electrode of the first transistor;

a fourth transistor comprising a first electrode coupled to the first node and a second electrode coupled to the second electrode of the first transistor, the fourth transistor being configured to transmit an initialization voltage to the first node;

a sixth transistor comprising a first electrode directly connected to the second electrode of the fourth transistor and a second electrode directly connected to a first electrode of the organic light-emitting diode such that the sixth transistor is coupled between the second electrode of the fourth transistor and the first electrode of the organic light-emitting diode; and a seventh transistor comprising a first electrode coupled to the first electrode of the organic light-emitting diode and a second electrode coupled to a power source configured to supply the initialization voltage, wherein, in an operational state of the pixel, the fourth transistor and the seventh transistor are configured to be simultaneously turned on.

2. The pixel of claim 1, wherein, in the operational state of the pixel, the initialization voltage successively passes through the seventh transistor and the fourth transistor and then passes to the first node.

3. The pixel of claim 1, further comprising:

a fifth transistor coupled between the first power source and the first transistor, wherein the sixth transistor is coupled between the second electrode of the fourth transistor and the first electrode of the seventh transistor, and wherein, in an operational state of the pixel, the fifth transistor and the sixth transistor are configured to be successively turned off.

4. The pixel of claim 1, further comprising:

a fifth transistor coupled between the first power source and the first transistor, wherein the sixth transistor is coupled between the second electrode of the third transistor and the second electrode of the fourth transistor, wherein, in an operational state of the pixel, the fifth transistor and the sixth transistor are configured to be simultaneously turned off.

5. The pixel of claim 1, further comprising:

a fifth transistor coupled between the first power source and the first transistor;

a seventh transistor coupled between the first electrode of the organic light-emitting diode and an initialization power source configured to supply the initialization voltage; and an eighth transistor coupled between the second electrode of the first transistor and the initialization power source, wherein the sixth transistor is coupled between the second electrode of the first transistor and the first electrode of the organic light emitting diode.

6. The pixel of claim 5, wherein, in an operational state of the pixel, the fourth transistor and the eighth transistor are configured to be simultaneously turned on.

7. The pixel of claim 6, wherein, in the operational state, the initialization voltage successively passes through the eighth transistor and the fourth transistor, and then passes to the first node.

* * * * *